United States Patent [19]

Nankee, II et al.

[11] Patent Number: 4,821,701

[45] Date of Patent: Apr. 18, 1989

[54] PURGE CORRUPTION DETECTION

[75] Inventors: Robert J. Nankee, II, Canton; Douglas C. Frantz, Lake Orion; James R. Tamm, Ypsilanti; Terry R. Gutermuth, St. Clair Shores, all of Mich.

[73] Assignee: Chrysler Motors Corporation, Highland Park, Mich.

[21] Appl. No.: 213,667

[22] Filed: Jun. 30, 1988

[51] Int. Cl.[4] ..... F00M 39/00

[52] U.S. Cl. ..... 123/520; 123/489

[58] Field of Search ..... 123/516, 518, 519, 520, 123/521, 489

[56] References Cited

U.S. PATENT DOCUMENTS

| | | | |
|---|---|---|---|
| 4,270,503 | 6/1981 | Pomerantz | 123/489 |
| 4,446,838 | 5/1984 | Suzuki et al. | 123/489 |
| 4,641,623 | 2/1987 | Hamburg | 123/520 |
| 4,664,087 | 5/1987 | Hamburg | 123/489 |
| 4,671,243 | 6/1987 | Deutsch | 123/489 |
| 4,677,956 | 7/1987 | Hamburg | 123/520 |
| 4,703,736 | 11/1987 | Atkins, Sr. | 123/489 |
| 4,703,737 | 11/1987 | Cook | 123/520 |
| 4,748,959 | 6/1988 | Cook | 123/489 |
| 4,763,634 | 8/1988 | Morozumi | 123/520 |

*Primary Examiner*—Carl Stuart Miller

*Attorney, Agent, or Firm*—Mark P. Calcaterra

[57] ABSTRACT

A system and method for the detection and correction of purge corruption in the adaptive memory portion of a control system controlling, in part, the fuel to air ratio during the cold start up of an internal combustion engine. This is achieved by performing two calibrations (or updates) of the adaptive memory cells (or locations) during the previous engine operation. The adaptive memory is first updated with the purge system off. The memory locations addressed at this time are denoted as the purge free adaptive memory cells. Next, the adaptive memory is updated with the purge system on. These memory locations are denoted as the normal adaptive memory cells. During the next cold engine start, purge corruption of the adaptive memory is detected when the difference between the two calibrations exceeds a value representing an absence of purge corruption.

3 Claims, 3 Drawing Sheets

FIG.1
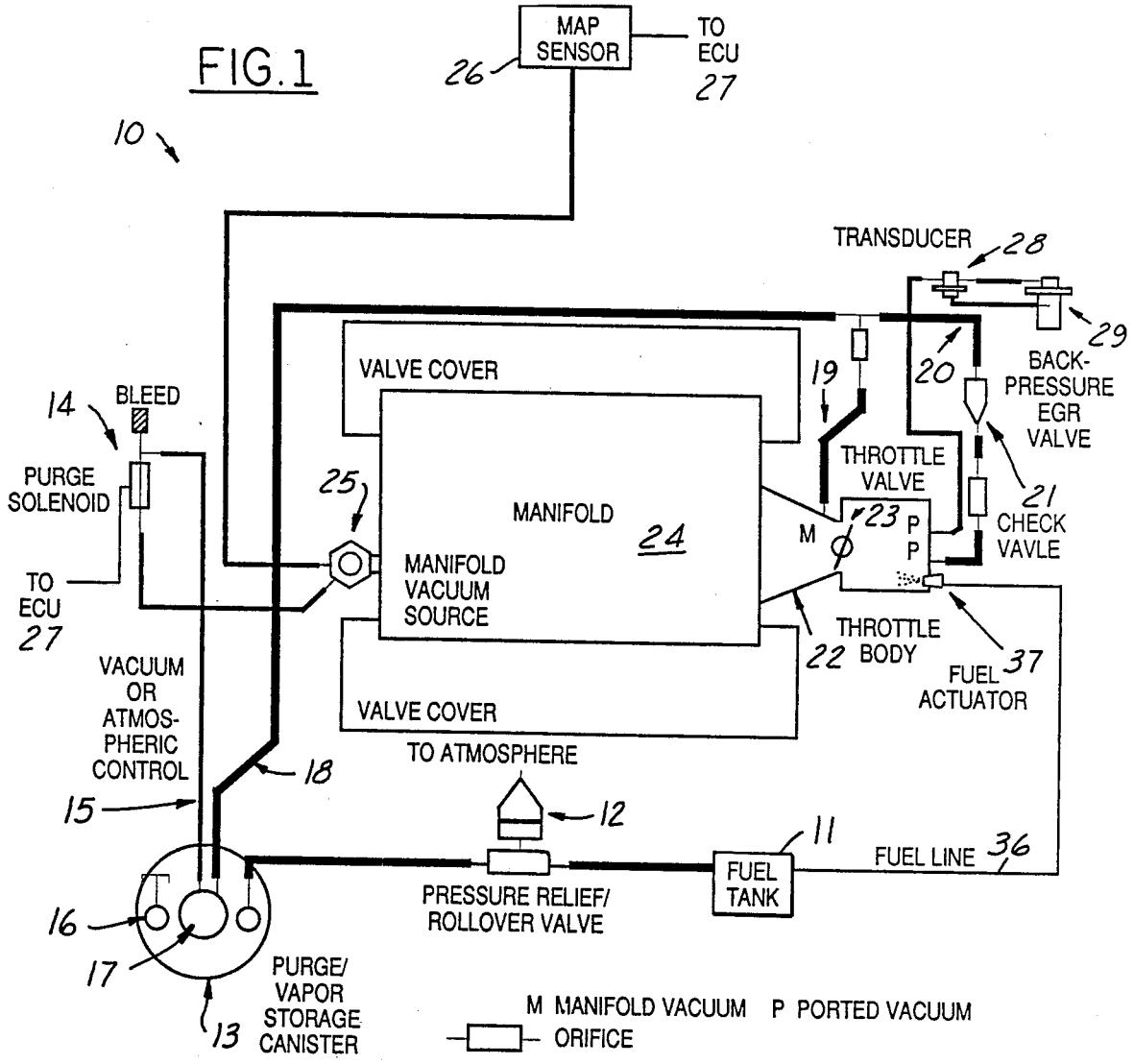
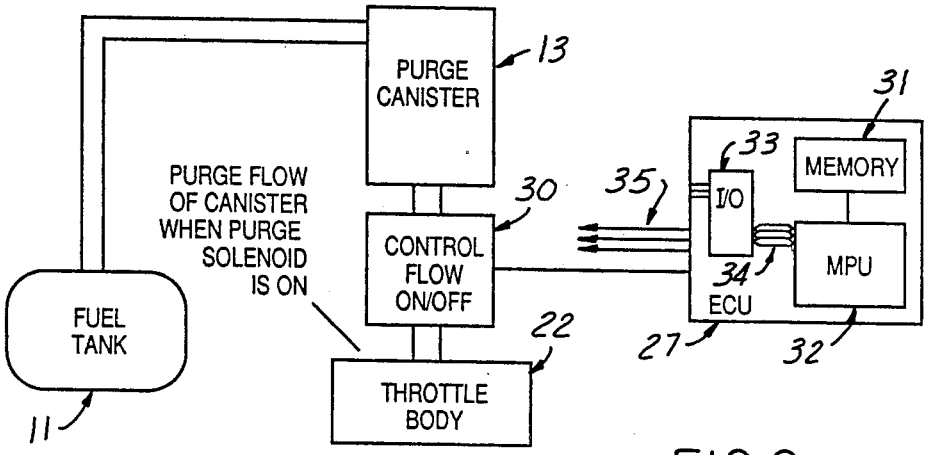
FIG.2

PURGE CORRUPTION DETECTION

BACKGROUND OF INVENTION

1. Field of Invention

This invention relates to purge corruption of the adaptive memory portion of a control system controlling, in part, fuel to air ratios, as may be used with the internal combustion engines of automotive vehicles. During a cold engine start, the invention detects and corrects purge corruption of the adaptive memory portion of the control system.

2. Description of Related Art

U.S. Pat. No. 4,703,736 to Chrysler Motors Corporation discloses a fuel vapor containment device typical of the common construction utilized by the automotive industry and is hereby expressly incorporated by reference.

U.S. Pat. No. 4,446,838 to Nissan Motor Co., Ltd. illustrates an evaporative emission control system.

U.S. Pat. No. 4,270,503 to General Motors Corporation discloses a closed loop air to fuel control system incorporating adaptive memory and is also hereby expressly incorporated by reference.

U.S. Pat. No. 4,671,243 to Motorola, Inc. discloses a control system monitoring and detecting oxygen sensor fault, also incorporating adaptive memory.

SUMMARY OF INVENTION

Adaptive memories are software systems and methods well known in the automotive industry. In general, such adaptive memories are initialized with a preset value regarding some parameter of the control system. These stored parameter values are then continuously updated and adjusted, in accordance with the operating conditions changing from one condition to another, in order to maintain a desired control over some aspect of the vehicle.

Under normal operating conditions, fuel vapors will form inside an automotive vehicle's fuel tank. These vapors are temporarily stored inside of the evaporative emission control system's vapor storage canister. These containment devices are also known as purge canisters, vapor canisters, and the like. A typical purge canister contains a quantity of activated charcoal as the preferred medium for the storing of fuel vapors. Because the purge canister's storage capacity is limited by the charcoal becoming saturated with absorbed fuel vapor, it is necessary to purge the canister with fresh air to remove the fuel vapor.

Under hot engine conditions, the excessive fuel vapor being produced is purged from the purge canister into the engine causing the fuel to air ratio to become richer. When the exhaust gas oxygen sensor in the exhaust system detects the rich fuel mixture, the fuel control system, operating closed loop, begins to compensate and lean out the fuel mixture to the desired ratio.

The closed loop fuel control system may be described as a system that, for any given set of operating conditions, fuel flow through the fuel line is provided by the fuel actuator (i.e. a throttle body fuel injector) to produce the fuel to air ratio set by the electric control unit (ECU) output. The fuel mixture is then burned and exhaust products leave the engine through the exhaust pipe. The exhaust gas oxygen sensor then generates a ECU input signal based on the fuel to air ratio. According to this input signal, the ECU's output directs the fuel actuator to adjust the fuel flow rate in an amount to achieve the desired fuel to air ratio, thus completing the loop.

Purge corruption develops when the engine is shut down while the purge canister is being purged (purge-on). When this occurs the adaptive memory does not return to its purgeoff (when the purge canister is not being purged) condition, rather, it remains in the purge-on state. During the next cold engine start, a purge-off situation, the ECU continues to apply the adaptive memory factor representing the previous purge-on conditions in calculating the fuel pulse width signal to be sent to the fuel actuator. The adaptive memory fails to adjust to the cold engine starting conditions because the fuel control system is operating open loop (input not based on measured output) and not closed loop. After a cold engine start, the exhaust gas oxygen sensor has not yet reached its operating temperature. At this point the exhaust gas oxygen sensor's signals are unreliable and therefore ignored by the ECU. Since the exhaust gas oxygen sensor's signals are ignored, the adaptive memory has no information on which an update may be based. The net effect of this open loop operation coupled with purge corruption is that the fuel to air ratio will be leaner than desired resulting in less than ideal engine performance and exhaust emissions.

The preferred embodiment of the subject invention achieves the desired objects by having performed two calibrations (or updates) of the adaptive memory cells (or locations) during the previous engine operation. First, the adaptive memory is updated with the purge system off. This is done once for every engine operation and usually takes approximately one minute. The memory locations addressed at this time are denoted as the purge free adaptive memory cells. Next, the adaptive memory is updated with the purge system on. This update is more of a continuous nature. These memory locations are denoted as the normal adaptive memory cells. During the next cold engine start, purge corruption of the adaptive memory is detected when the difference between the two calibrations exceeds a value representing an absence of purge corruption.

It is the general object of the invention to provide a fuel control system that will supply the correct fuel to air ratio to the engine during the next cold engine start after purge corruption of the adaptive memory has occurred.

It is the object of the invention to provide a control system that will detect purge corruption of the adaptive memory of the fuel control system during the next cold engine start after purge corruption has occurred.

It is the object of the invention to provide a control system that will correct purge corruption of the adaptive memory of the fuel control system during the next cold engine start after purge corruption has occurred.

Another general object of the invention is to increase engine performance and decrease exhaust emissions by supplying the correct fuel to air ratio to the engine during the next cold engine start after purge corruption of the adaptive memory portion of the fuel control system has occurred.

DESCRIPTION OF THE DRAWINGS

Other objects, features and advantages of the present invention will become more fully apparent from the following Detailed Description of the Preferred Embodiment, the appended claims and in the accompanying drawings in which:

FIG. 1 is a schematic view illustrating the bi-level purge system of an automotive vehicle in relation to various other aspects of an internal combustion engine.

FIG. 2 is a schematic view separately depicting the main components typically found in an automotive vehicle's purge system.

DETAILED DESCRIPTION OF THE PREFERRED EMBODIMENT

Figure 3:
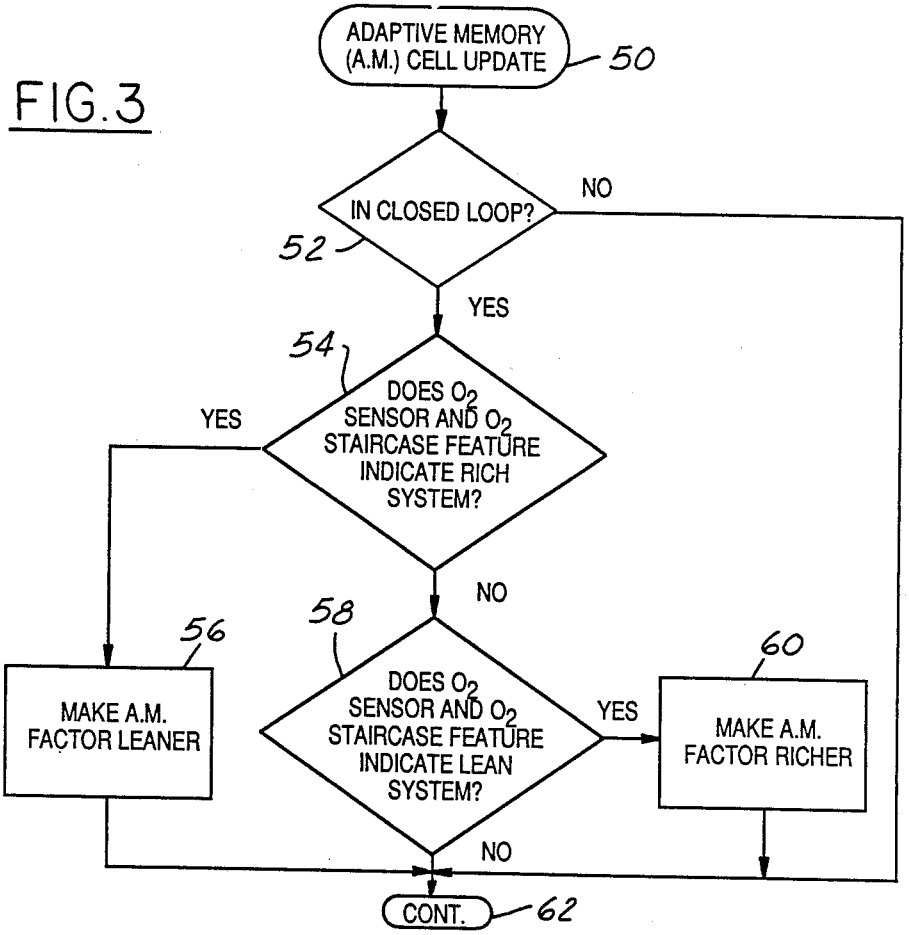
FIG. 3 is a flowchart showing a method of adaptive memory cell updating or calibration.

Referring to FIG. 1, under normal operating conditions, fuel vapors will form in fuel tank 11 of purge system 10. A conduit directs the excess fuel vapor from the fuel tank 11, through a pressure relief/rollover valve 12, and into the vapor storage canister 13 (also known as the purge canister 13).

Fuel vapors are temporarily stored in the purge canister 13 until a purge-on situation is detected by the control system. A general control system includes such parts as an ECU 27, sensors (including a MAP sensor 26), and various actuators. Under hot engine operating conditions, a purge-on situation, purge solenoid 14 is engaged by the control system's ECU 27. Once engaged, the purge solenoid 14 allows negative pressure, originating from manifold 24 through multi-port manifold vacuum source conduit 25, to be applied through vacuum control line 15 of the purge system 10. The negative pressure of the vacuum control line 15 then causes purge valve 17 of the purge canister 13 to open. Fuel vapor is then purged from the purge canister 13 into purge line 18 by the inflow of fresh air through the purge canister 13. Port 16 is an extra port on the purge canister 13 and is capped and not utilized in the purge system 10 shown.

During engine idle, the purged fuel vapor flows through purge line 19 into throttle body 22 below throttle valve 23. Purge line 19 entering the throttle body 22 below the throttle valve 23 is controlled by manifold vacuum pressure, while purge line 20, entering the throttle body 22 above the throttle valve 23, is controlled by ported vacuum pressure. During engine idle, purge line 20 is held at atmospheric pressure and fuel vapor flow through purge line 20 into the throttle body 22 above the throttle valve 23 is restrained. Reverse fuel vapor flow through purge line 20 is inhibited by check valve 21. When running off idle, the engine is capable of burning more purged vapor. In this case, fuel actuator 37 injects fuel from fuel line 36 into throttle body 22 and the throttle valve 23 opens. The opening of the throttle valve 23 lowers the ported vacuum pressure and purged vapor flows through both purge line 19 and purge line 20.

Also shown in FIG. 1 are a transducer 28 and back-pressure/exhaust gas recirculation (EGR) valve 29. These two items function with the EGR system (not fully shown) which allows exhaust gas to be recirculated back into the throttle body 22 to reduce exhaust emissions.

FIG. 2 is a schematic diagram showing the basic components of the purge system 10. Excess fuel vapor flows from the fuel tank 11 into the purge canister 13. The signal controlling the on/off flow 30 of fuel vapor from the purge canister 13 is produced by the ECU 27. The ECU 27 is comprised of a microprocessing unit (MPU) 32, memory 31, input/output module (I/O) 33, (address, control and data) bus lines 34, and other hardware and software to control fuel to air ratios, fuel spark timing, EGR, and other tasks of engine control. When engaged by the ECU 27, the purge solenoid 14 turns the purge system 10 on and fuel vapor is purged from the purge canister 13 into the throttle body 22.

Figure 4:
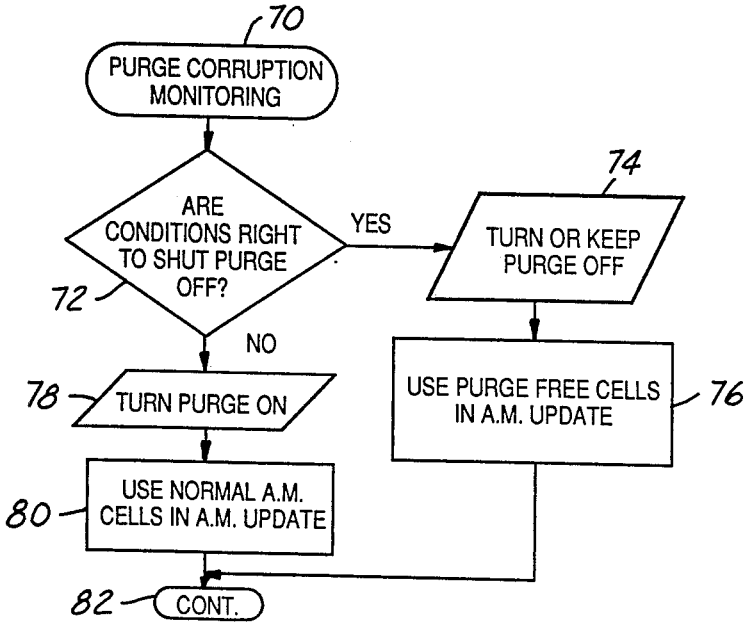
FIG. 4 is a flowchart showing a method of monitoring whether the normal adaptive memory cells or the purge free adaptive memory cells are to be used in the adaptive memory cell updating of FIG. 3.
Figure 5:
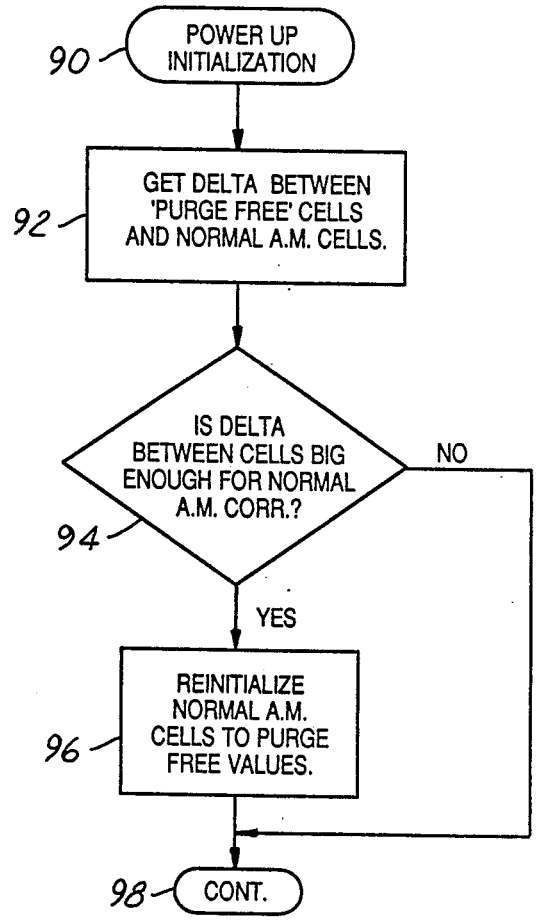
FIG. 5 is a flowchart showing a method for the detection and correction of purge corruption during the next power up initialization of the control system after purge corruption of the adaptive memory has occurred.

Referring to FIG. 3, FIG. 4, and FIG. 5, flowcharts are shown which illustrate the method of detecting and correcting purge corruption and the interaction between such detection/correction and adaptive memory cell updating.

FIG. 3 is a flowchart showing a method of adaptive memory cell updating. In determining the actual adaptive memory cell to be addressed, the ECU 27 looks at RPM and the MAP. The method begins at block 50 and falls through to decision block 52. If the fuel control system is not operating closed loop (i.e. the exhaust gas oxygen sensor has not warmed up to the proper operation temperature), the method branches to block 62 and the ECU 27 is released to continue other tasks.

Returning to decision block 52, if the fuel control system is operating in the closed loop mode (i.e. under hot engine conditions), the method proceeds to decision block 54 where the exhaust gas oxygen sensor (02 sensor) and the staircase feature (further explained in FIG. 6) are checked to determine if a rich fuel mixture is being supplied to the engine. If a rich fuel mixture is indicated, the method branches to block 56 where the adaptive memory factor, as previously described, is updated to indicate that a leaner fuel mixture is required. The method then proceeds to block 62 where the ECU 27 is released to execute other tasks.

Returning to decision block 54, if a rich fuel mixture is not indicated, the method proceeds to decision block 58. In decision block 58 the exhaust gas oxygen sensor and the staircase feature are checked to determine if they indicate that the engine is being supplied with a lean fuel mixture. If the fuel mixture is determined to be lean, the method branches to block 60 where the adaptive memory factor is updated to indicate that a richer fuel mixture is required. The method then proceeds to block 62 and the ECU 27 is released. If the fuel mixture is not indicated as being lean in decision block 58, then the method proceeds to block 62 and the ECU 27 is released to continue other tasks.

FIG. 4 is a flowchart illustrating a method of determining whether normal adaptive memory cells or purge free adaptive memory cells are to be used in the adaptive memory cell updates of FIG. 3. Both types of adaptive memory cells are contained within the memory 31 of the ECU 27. Purge free adaptive memory cells are those memory 31 locations which are updated in FIG. 3 when the purge system 10 is off. These cells therefore do not take into consideration the effects of the purged vapor on the richness of the fuel mixture. Normal adaptive memory cells are those memory 31 locations which are updated in FIG. 3 when purge system 10 is on. The normal adaptive memory cells are the memory 31 locations which are subject to possible purge corruption. The method begins at block 70 and falls through to decision block 72.

At decision block 72, the control system determines if conditions dictate that the purge system 10 should be turned off or kept off. While this is a complex decision involving many algorithms, some of the parameters involved include: the length of time the purge system 10 has been off; number of times the adaptive memory cells have been updated; RPM; MAP; throttle angle; and whether the fuel control system is operating closed loop. If conditions are right to shut the purge system 10 off, the method branches to block 74. At block 74 the purge system 10 is shut off (if the system is on) or kept off (if the system is already off). From block 74 the method proceeds to block 76 where the ECU 27 is signaled to use the purge free adaptive memory cells in the adaptive memory cell update of FIG. 3. The method then proceeds to block 82 where the ECU 27 is returned to complete other jobs.

Returning to decision block 72, if the conditions are not right to shut down the purge system 10 (looking at the previously mentioned parameters), the method proceeds to block 78. In block 78 the purge system 10 is either turned on or kept on, depending on the existing state of the purge system 10. Once the purge system 10 is turned on in block 78, the method proceeds to block 80. In block 80, the ECU 27 is directed to use the normal adaptive memory cells in the adaptive memory cell update of FIG. 3. From block 80 the method falls through to block 82 and the ECU 27 is released.

Referring back to decision block 72, the method continues to branch to block 74 until the ECU 27 is satisfied that an accurate fuel pulse width signal is being provided to the fuel actuator during a purge-off situation. Once the purge free adaptive memory cells are satisfactorily updated for the present engine operation, those adaptive memory factors will be applied throughout the present period of engine operation whenever the purge system is off. They will not be updated again until the next period engine operation. This is antagonistic to the update of the normal adaptive memory cells, which occurs virtually continuously throughout the present period of engine operation.

FIG. 5 is a flow chart showing a method of purge corruption detection and correction during the power up initialization of the fuel control system. The power up initialization of FIG. 5 occurs during the next cold engine start after purge corruption has occurred. That is, FIG. 3 and FIG. 4 will have occurred during the last period of engine operation and FIG. 5 will occur at the beginning of the next period of engine operation. The method begins at block 90 and falls through to block 92. At block 92 the difference between the purge free adaptive memory cells and the normal adaptive memory cells is calculated. The method then proceeds to decision block 94 to determine if the difference between the purge free and the normal adaptive memory cells is large enough to indicate that the normal adaptive memory cells have been corrupted.

At decision block 94, if the difference between the purge free and the normal adaptive memory cells is not large enough to indicate that purge corruption has occurred, power up initialization is complete. The method branches to block 98 and the ECU 27 is released to perform other tasks.

If in decision block 94 the difference between the normal and purge free adaptive memory cells is large enough to indicate purge corruption of the normal adaptive memory cells, the method proceeds to block 96. At block 96 the purge corruption of the normal adaptive memory cells is corrected. This is done by reinitializing the normal adaptive memory cells to the values then presently contained in the purge free adaptive memory cells. Once reinitialization is completed, the method proceeds to block 98 where the ECU 27 is released to continue other tasks.

Figure 6:
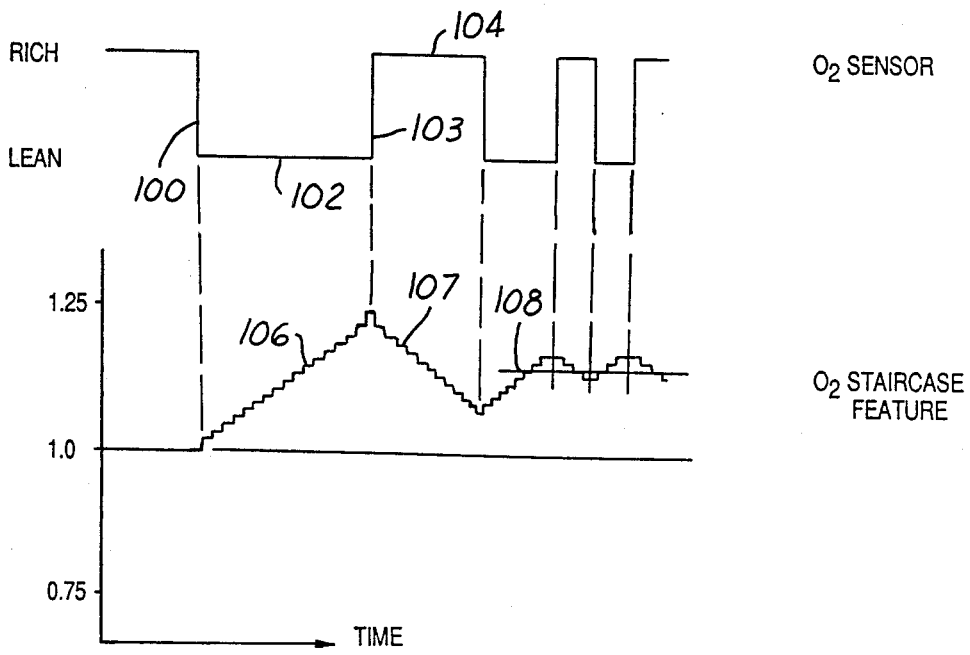
FIG. 6 is a timing diagram showing hypothetical signals produced by the exhaust gas oxygen sensor ($O_2$ sensor) and the corresponding values retained in memory by the staircase feature ($O_2$ staircase feature).

Referring to FIG. 6, line 100 indicates that the exhaust gas oxygen sensor has switched from reading a rich fuel mixture to reading a lean fuel mixture. Along line 102 the exhaust gas oxygen sensor continues to read a lean fuel mixture.

Upon first entering closed loop operation of the fuel control system, the staircase feature begins to increase (or decrease if the exhaust gas oxygen sensor signals a rich fuel mixture) in value, line 106. The staircase feature is stored in memory 31 of the ECU 27 and continues to increase in value until the exhaust gas oxygen sensor indicates a fuel mixture change from lean to rich, line 103.

The change in exhaust gas oxygen signal can be attributed, in part, to the staircase feature itself. The staircase feature is utilized by the ECU 27 in the fuel pulse width equation used to calculate the signal to be supplied to the fuel actuator 37.

Once the exhaust gas oxygen sensor reads a rich fuel mixture (line 104), the staircase feature begins to decrease in value until the exhaust gas oxygen sensor signal again switches to lean, line 107. With time, the staircase feature will settle about line 108 representing the staircase feature value needed to produce the desired fuel to air ratio from the pulse width equation. This line is distinctive with each automotive vehicle for closed loop operation. However, during open loop operation, this value is set equal to 1.0 in the fuel pulse width equation.

The effects of the adaptive memory factor in the pulse width equation are such that the staircase feature will be nominalized and line 108 will correspond with a value of 1.0 during closed loop operation.

After adaptive memory nominalization of line 108, two benefits are enjoyed. First, during open loop operation of the fuel control system, any percent increase needed in the desired fuel to air ratios for proper cold engine operation will be consistent from car to car. Second, at the onset of closed loop operation, the excess ramping of line 106 to reach the desired fuel to air ratio (line 108) will be eliminated.

While the present invention has been disclosed in connection with the preferred embodiment thereof, it should be understood that there may be other embodiments which fall within the spirit and the scope of the invention and that the invention is susceptible to modification, variation and change without departing from the proper scope and fair meaning of the following claims.

We claim:

1. In an internal combustion engine having a throttle means, and a manifold; a fuel control system with evaporative emission controls (purge system) comprising a fuel tank, a pressure relief valve, a vapor storage canister, a purge solenoid, a purge valve, and a check valve, for the internal combustion engine, the fuel control system working in conjunction with an engine control unit (ECU) with a memory, microprocessing unit, and an input/output (I/O) module; a fuel actuator; a manifold absolute pressure (MAP) sensor, and exhaust gas oxygen sensor; an adaptive memory cell update method for the detection and correction of a possible purge corruption of the adaptive memory portion of the memory in the ECU, the adaptive memory portion having purge free cells and normal cells, the method comprising:

determining the adaptive memory cells to be used during the adaptive memory cell update by determining if the engine conditions are right to turn the purge system off;

if the conditions are right to turn the purge system off, turning the purge system off and using the purge free cells in the adaptive memory cell update;

if the conditions are not right to turn the purge system off, turning the purge system on and using the normal cells in the adaptive memory cell update.

2. An adaptive memory cell update method as claimed in claim 1, where the memory contains a staircase method (feature) to assign a time dependent value representing the amount of change in a fuel pulse width signal in the fuel control system needed to cause the exhaust gas oxygen sensor signal to switch from a lean fuel mixture to a rich fuel mixture and vice versa, the staircase method for determining, the optimal fuel to air ratio for the particular automotive vehicle, the adaptive memory cell update method comprising:

determining if the fuel control system is operating closed loop, ending the adaptive memory cell update if the fuel control system is operating open loop, and if the fuel control system is operating closed loop, checking the condition of the exhaust gas sensor and the staircase feature;

if the exhaust gas oxygen sensor and the staircase feature indicate a rich fuel to air ratio, making the adaptive memory factor leaner and then ending the adaptive memory cell update, and if the exhaust gas oxygen sensor and the staircase feature do not indicate a rich fuel to air ratio, checking the exhaust gas oxygen sensor and staircase feature for a lean fuel to air ratio;

if the exhaust gas oxygen sensor and the staircase feature do not indicate a lean fuel to air ratio, then ending the adaptive memory cell update, and if the exhaust gas oxygen sensor and the staircase feature indicate a lean fuel to air ratio, making the adaptive memory factor richer.

3. An adaptive memory cell update method as claimed in claim 1, in which the purge corruption detection and correction during power up initialization comprises:

retrieval of the purge free adaptive memory cell value by the ECU for the given engine operating conditions, retrieval of the normal adaptive memory cell value by the ECU for the given engine operating conditions, determination by the ECU of the difference between the purge free adaptive memory cell value and the normal adaptive memory cell value;

if the difference between the purge free adaptive memory cell value and the normal adaptive memory cell value is less than a preset value representing an absence of adaptive memory corruption, ending the power up initialization; and if the difference between the purge free adaptive memory cell value and the normal adaptive memory cell value is greater than the preset value representing an absence of normal adaptive memory corruption, reinitializing the normal adaptive memory cell values to the purge free adaptive memory cell values.

* * * * *